United States Patent [19]

Mäkinen

[11] 4,355,704

[45] Oct. 26, 1982

[54] PROCEDURE FOR FINE POSITIONING AN ALTERNATING CURRENT LIFT

[75] Inventor: Heimo Mäkinen, Hyvinkää, Finland

[73] Assignee: Elevator GmbH, Zug, Switzerland

[21] Appl. No.: 182,409

[22] Filed: Aug. 26, 1980

[30] Foreign Application Priority Data

Aug. 28, 1979 [FI] Finland ..... 792674

[51] Int. Cl.[3] ..... B66B 1/28

[52] U.S. Cl. ..... 187/29 R

[58] Field of Search ..... 187/29; 318/592, 618, 318/812, 814

[56] References Cited

U.S. PATENT DOCUMENTS

| | | | |
|---|---|---|---|
| 4,052,651 | 10/1977 | Kamaike | 187/29 X |
| 4,083,431 | 4/1978 | Oohira et al. | 187/29 |
| 4,150,734 | 4/1979 | Ohira et al. | 187/29 |
| 4,181,197 | 1/1980 | Tanabe et al. | 187/29 |
| 4,235,309 | 11/1980 | Kuhl | 187/29 |

FOREIGN PATENT DOCUMENTS

| | | | |
|---|---|---|---|
| 52-16617 | 2/1977 | Japan | 318/814 |

*Primary Examiner*—Stanley J. Witkowski
*Assistant Examiner*—W. E. Duncanson, Jr.
*Attorney, Agent, or Firm*—Martin Smolowitz

[57] ABSTRACT

Procedure for exact aligning with the storey floor level of a lift cage driven by an alternating current motor, wherein the current in one or several phases of the lift's drive motor (2) is choked with a controllable choke element (22). The control is governed by a control unit (23) which receives information of the lift cage's (8) true velocity, constituting a feedback-connected control loop which imparts to the lift cage in fine adjustment running a low velocity from which the lift cage is able to stop at the storey floor level within a required tolerance range.

1 Claim, 5 Drawing Figures

PROCEDURE FOR FINE POSITIONING AN ALTERNATING CURRENT LIFT

Figure 1:
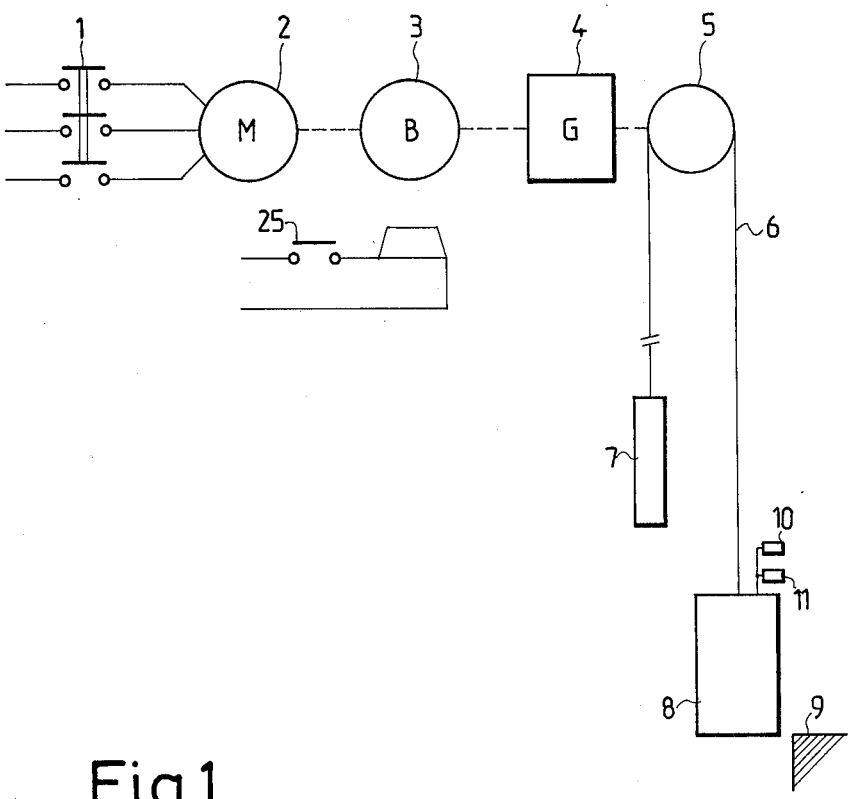

The present invention concerns a procedure for the exact aligning with the floor level, of a lift cage powered by an alternating current motor, wherein the current in one or several phases of the lift-operating motor is choked with the aid of controllable choke elements.

Requirements regarding the exact stopping of a lift cage vary in different applications. Particularly high requirements are imposed on lifts which are employed in such goods transport where the loading and unloading is accomplished by means of vehicles on wheels or by carriages that can be pushed. A step of excessive height between the floor level of the storey and the lift cage floor may inhibit the loading operation or cause the load to be overturned. It is commonly required that in the case of goods lifts the maximum discrepancy between lift cage floor and storey floor level is 5 mm at a maximum.

The loading and unloading of the lift cage is attended by changes of distension in the suspension wires, whereby the lift cage may possibly move upwardly or downwardly up to a few centimeters. The inaccuracies hereby incurred must also be corrected by returning the lift cage to be within the tolerance range.

The exact positioning of a lift cage to be aligned with the storey floor level is one of the central problems in lift technology and in view of this problem the following solutions, among others, are known in the art, which have the typical feature that the lift cage may be moved with an exceedingly low velocity.

One possible solution is direct current operation. It is possible with a feedback-connected d.c. drive to operate the lift at a very low speed in the neighbourhood of any storey floor level. It is then possible, due to the low speed, to stop the lift with the required high accuracy. But d.c. machinery and its control systems are expensive, and they are therefore used, owing to their characteristics, mainly in passenger lift traffic in high-rise houses where high speeds are necessary.

Another problem solution is a separate fine positioning machinery. In this solution there is connected to the drive motor proper of the lift, over a disengagable (for instance magnet-operated clutch, another machinery comprising a motor and a gear transmission. The transmission ratio of the additional machinery is so selected that the lift cage can be run at a low enough speed. The drawback of this procedure are the requisite special designs in the mechanical constructions, owing to which as a rule standard machinery units cannot be used. The design of this procedure moreover requires more space in the lift machinery room, and it is comparatively expensive.

One possible way to overcome the fine positioning problem is to apply hydraulics. A few lift manufacturers have solved the problem either by moving the lift cage by hydraulic means in the cage-bearing framework or by moving the anchoring point of the lift cage suspending wires in the machinery room, whereby the lift cage also moves. Both solutions enable a small enough speed to be imparted to the lift cage for accurate positioning to be successful. But hydraulic systems are rather expensive and complex.

Still one way to accomplish accurate positioning of a lift cage is controlled a.c. operation, which became commonly used in lift technology in the 1970's. In problem solutions of this type commonly a three-phase motor with short-circuited rotor is used, at least this is so in all simpler lifts. The speed of rotation of the cage-rotor motor is controlled with the aid of semiconductors, such as thyristors for instance. It is a typical feature of these procedures that the accelerating of the motor is controlled by changing the stator voltage and the retardation, either by eddy-current braking with direct current or by reverse-running braking with stator voltage control. Such controlled a.c. drives are also able to move the lift cage at a low enough speed for accurate aligning with the floor level to be possible. However, applications of such drives are only economical when other requirements are also imposed on the performance of the lift, exactly as with d.c. lifts.

The object of the present invention is to provide a procedure involving a control system by which it is possible to move the lift cage at low speed and where the control system is free of the drawbacks described. The invention is appropriate to be used in connection with lifts driven by cage-rotor motor, and it is based on control of the speed of the lift drive motor proper, in a simple way. The procedure of the invention is characterized in that the control is governed by a control unit which receives information of the true speed of the lift cage, constituting a control system with feedback imparting to the lift cage in fine adjustment operation a stable, low speed from which the lift cage may stop at the floor level within the required tolerance range.

The procedure according to one embodiment of the invention is characterized in that the speed control of the lift drive motor operates actively in that range only where the motor's counter-torque is positive and that when the motor's counter-torque is negative the speed of the lift cage is controlled with the aid of the lift brake and the lift cage speed measuring unit.

The procedure according to another embodiment of the invention is furthermore characterized in that, as required, several fine adjustment runs are made until the lift cage stands at the storey floor level within the required tolerance range.

The advantage of the procedure of the invention is, among other things, that application of the invention is not dependent on the mechanical design of the lift machinery. Furthermore, the cost of the structure according to the invention is low. Owing to these facts, the invention is particularly applicable in connection with lifts which are used to transport goods but where no high speeds nor very smooth running are required. Thus the normal drive system of the lift may be the simplest possible, for instance a single-speed cage-rotor motor drive.

Figure 2:
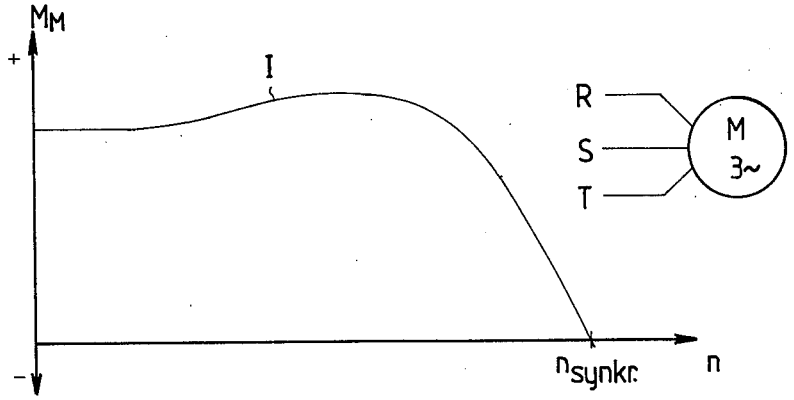
Figure 3:
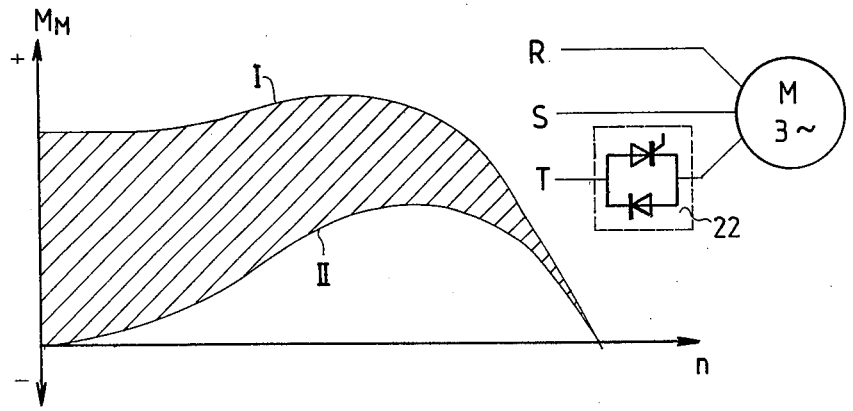
Figure 4:
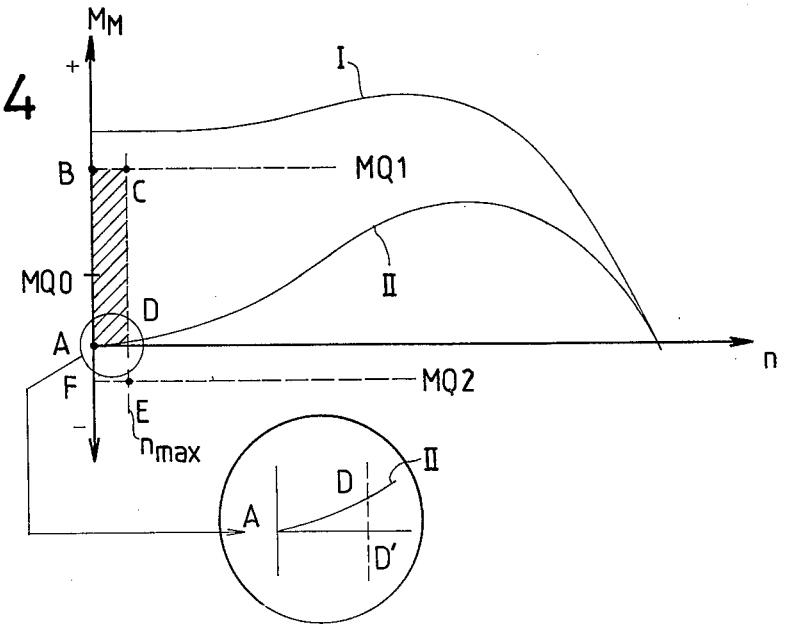
Figure 5:
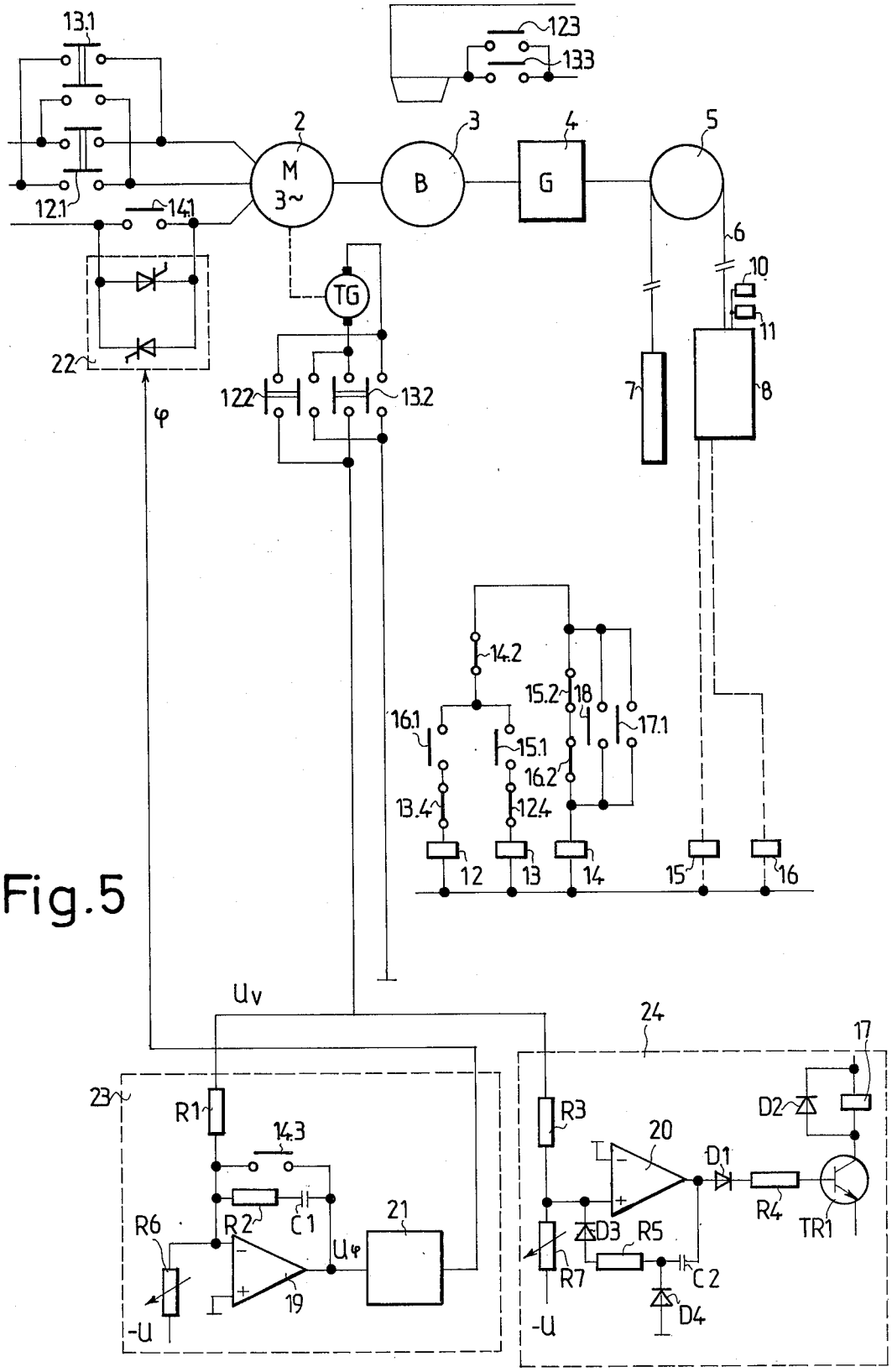

In the following, the procedure of the invention is described in greater detail, with reference being made to the attached drawings, wherein:

FIG. 1 presents a typical lift with cage-rotor motor drive;

FIG. 2 displays a typical torque graph, plotted over the motor speed, of a three-phase short-circuited rotor lift motor, and the motor circuit consistent with this graph;

FIG. 3 displays, in addition to the normal torque graph (I), the torque graph (II) consistent with the situation in which one phase of the motor has been placed in no-current state, and the equivalent motor circuit;

FIG. 4 shows, in addition to the torque graphs (I) and (II), the levels MQ1 and MQ2 representing the maximum and minimum values of the counter-torque caused by the load in the lift cage, and an enlarged detail from the initial part of the torque graph (II); and FIG. 5 shows a circuit by which the procedure of the invention may be carried out.

FIG. 1 shows a typical lift driven by a cage rotor motor. When the relay 1 is closed, voltage is applied to the motor 2 and the mechanical brake 3 likewise receives a voltage. The brake 3 is, for instance, of the magnetically released type, whereby when the switch 25 is closed the motor rotates the traction wheel 5 over the gear transmission 4. The lift cage 8 and counterweight 7 are suspended by ropes 6 from the traction wheel 5. The speed of the lift cage 8 is dependent on the speed of rotation of the motor 2, on the gear ratio of the transmission 4 and on the diameter of the traction wheel 5. The load in the lift cage affects the load imposed on the motor, whereby the speed is also dependent on the load unless the motor speed is controlled.

When the lift cage 8 is brought to a standstill at a storey floor level 9, the relay 1 releases its armature, whereby the motor 2 ceases to supply torque and the brake 3 begins to engage. The brake has inertia, so that a braking torque is only generated after a time tB has passed counted from the moment when the relay 1 falls off. During this time tB, the speed of the lift cage is either decelerated or accelerated depending on the direction of travel, on the load in the lift cage and on mechanical disturbances in the system. This deceleration shall be denoted with the symbol a1 in such manner that a positive or negative value implies deceleration or acceleration, respectively. When the brake 3 has become fully engaged, the speed of the lift cage will slow down with deceleration aB, which is dependent on the characteristics of the brake, in addition to the load, the direction of travel and the losses. After the relay 1 has fallen off, the lift cage moves in accordance with the laws of mechanics through the distance s which can be presented by the formula 1.

$$s = \frac{2v - a_1 \cdot t_B}{2} \cdot t_B + \frac{(v - a_1 t_B)^2}{2a_B} \qquad (1)$$

In formula 1, v stands for the velocity of the lift cage at the moment when the relay 1 falls off.

When it is desired to adjust the lift cage 8 with accuracy $\pm\Delta s$ at the storey floor level 9, it is usual to this end to mount on the lift cage pick-ups 10 and 11 which supply the logics signal "1" in case the lift cage is positioned above or below, 11 or 10, by the distance $\pm\Delta s$. When the lift cage is moving towards the storey floor level, the situation arises in which both pick-up 10 and pick-up 11 transmits the logics datum "0". If the lift is stopped at this point, the distance s calculated from formula 1 has to be less than $2\cdot\Delta s$ in order that, after coming to a standstill, the lift cage might remain within the tolerance span $\pm\Delta s$. It follows that one finds a limit value for the speed at which the floor level is being approached, this limit value being represented by formula 2.

$$v < \sqrt{a_B(a_B - a_1)t_B^2 + 4a_B\Delta s} - (a_B - a_1)t_B \qquad (2)$$

It is obvious that the velocity value is lowest when tB is maximum, a1 is at its minimum (negative) and aB at its minimum. The variables tB, a1 and aB assume typically approximately equal values regardless of the lift type involved.

The following exemplary case will serve to clarify the relation of the fine adjustment speed to the nominal speed of the lift cage.

Assuming the tolerance requirement $\Delta s = 5$ m and $tB = 100$ ms, $a1 = -0.4$ m/s$^2$ and $aB = 0.7$ m/s$^2$, the limiting value $v < 0.037$ m/s is found for the speed of approach. The nominal speeds of a.c. lifts are in the range from 0.3 to 1.25 m/s, and the typical standard speed of goods lifts is 0.63 m/s. Therefore the speed at which the fine adjustment is performed may not be more than a few percent of the lift's nominal speed. For instance, with a standard speed goods lift $v = 0.63$ m/s, the fine adjustment speed is thereof about 6%.

In the following shall be illustrated with the aid of FIGS. 2, 3, 4 and 5 the manner in which in the procedure of the invention the lift cage speed control and the stopping of the lift cage have been carried out in order that the lift cage will stop within the tolerance range.

In the procedure of the invention the fine adjustment run takes place independently if the lift cage is stationary outside the tolerance range. It is therefore immaterial whether incorrect arrest of the lift upon normal stopping has occurred or the lift cage has been displaced owing to loading or unloading. In the situation depicted in FIG. 3, a controllable choking element 22 has been connected into that phase of the motor which has been placed in zero-current state, and this element chokes or reduces the current. The torque of the motor may then be controlled within the hatched area between the curves (I) and (II). As such choking element may be used the pair of thyristors TY shown in FIG. 3, or a triac, or another controllable choking element. If choking elements are inserted in two or three phases, then the torque may be controlled within the area enclosed by the curve (I) and the n axis. The maximum value of the counter-torque generated by the load in the lift cage, seen in FIG. 4 and which is represented by the level MQ1, corresponds to the situation in which the fully loaded lift cage is run upward (or the empty cage downward); and the minimum, represented by the level MQ2, corresponds to the situation that the fully loaded lift cage is being run downward (or the empty lift cage upward). When the lift cage has been loaded to half its nominal capacity, the losses alone resist the movement, and these are represented by the torque level MQ0. In practice, MQ2 is slightly negative, but $|MQ1| > |MQ2|$. In FIG. 4 has furthermore been indicated the level nmax, which is that speed of rotation at which is reached the highest allowable velocity in fine adjustment operation, according to formula (2). Therefore, the region within which the controlling of speed has to take place is delimited inside the rectangle formed by the points B-C-E-F shown in FIG. 4. By means of a choking arrangement as shown in FIG. 3, the motor torque may be controlled within the shaded area A-B-C-D in FIG. 4. If choking is practiced in several phases, the controllable area will be A-B-C-D'. However, the difference between D and D' is minimal in such degree that the choking of one phase, as in FIG. 3, is in practice equal in value to the choking of several phases. The area A-D-E-F seen in FIG. 4 is an area in which the motor torque cannot be controlled by choking.

The apparatus constituting the circuit of FIG. 5 enables the procedure of the invention to be implemented. Let us consider, separately, two cases whereof case 1 is topical when the load in the lift cage is such that the motor has a counter-torque between 0 and MQ1. In that case we are operating in the region A-B-C-D of FIG. 4, where the motor pulls the lift cage.

When the lift cage 8 is stationary, the relays 12 and 13 are at rest (armatures released), whereby the motor 2 receives no voltage and the brake 3 is on. The relays in this circuit have been indicated with reference numerals so that one numeral alone refers to the winding component of a relay, while the same numeral with added subscript indicates the contacts of that relay. Thus, for instance, "relay 12" means the whole relay represented in FIG. 5 by the winding component 12 and the contacts 12.1, 12.2, 12.3 2 and 12.4. The relay 14 keeps its armature attracted as long as relay 18 is energized. Of the relay 18 only the contact part is visible in FIG. 5. The relay 18 is a relay having its place in the other controls of the lift and it keeps its armature attracted whenever the lift is in normal run, and it releases its armature an appropriate while after the lift cage has become stationary at the storey floor level. When the lift cage is stationary below the storey floor level by a distance more than Δs, a fine adjustment run becomes necessary. In that case the pick-up 11 on the lift cage transmits the logical signal "1" and relay 16 attracts its armature. The relay 17 is deenergized at this stage and after relay 18 has released its armature, relay 14 releases its own. Now, relay 12 is energized and attracts its armature, connecting voltages to the motor 2 and brake 3. The tachometer TG, connected to the motor, supplies over the contacts 12.2 of relay 12 a voltage Uv which is proportional to the motor's speed of rotation, that is, to the velocity of the lift cage. The voltage Uv is positive if the lift cage is travelling upward with the relay 12 energized. In the control unit 23, the amplifier 19 has been connected in an integrator circuit with the aid of resistor R2 and capacitor C1. When relay 14 is energized with its armature attracted, the output voltage Uϕ of the amplifier is zero. When relay 14 releases its armature, the amplifier 19 starts to integrate the sum of voltages −U and Uv through the adjustable resistor R6 and resistor R1. At the starting moment when relay 12 attracts its armature, the voltage Uϕ is zero.

The ignition unit 21 supplies to the choke element 22, which may be for instance the thyristor pair depicted in the figure, the control ϕ, which is proportional to the control voltage Uϕ so that the thyristors in the choke element 22 are in non-conductive state when Uϕ is zero and the thyristors conduct completely when Uϕ has its positive maximum value. The design of the ignition unit has not been presented in any greater detail because for it a number of design solutions commonly known in the art are available. At the starting moment, the motor 2 is thus understood to receive current from only two phases, and no torque is generated in the motor. As the motor does not rotate in the desired direction, the amplifier 19 will only integrate the voltage −U, whereby the control voltage Uϕ increases in the positive direction, making the thyristors conductive and causing the motor torque to increase. The motor starts to rotate, whereby the voltage Uv from the tachometer TG begins to compensate the voltage −U at the integrator amplifier 19. Hereby a feedback-connected control loop is created which settles at a stable state such in which Uϕ is constant, Uv is constant and with regard to Uv the formula 3 is valid as follows:

$$U_v = \frac{R1}{R6} \cdot U \tag{3}$$

The resistors R1 and R6 are selectable so that the voltage Uv is consistent with a lift cage speed such as will satisfy the condition imposed by formula (2). As the lift cage moves upward, it will in due time enter the tolerance range ±Δs, when the relay 16 will release its armature, at the same time deenergizing relay 12. Since the velocity of the lift cage is low enough, the lift cage will come to a standstill within the tolerance range ±Δs. The speed is settable by means of the adjustable resistor R6.

In the situation of case 2, the load in the lift cage is such that the motor's counter-torque ranges between 0 and MQ2. We are then operating in the region A-D-E-F in FIG. 4 in which the lift cage "pulls" the motor. Let us for the sake of simplicity only consider the situation that the lift cage is being run upward. The downward run is fully equivalent, merely with other relays operating. Now, the lift cage tends to move owing to the load, of itself, in that direction in which the running should take place. If the speed of the lift cage were controlled with the motor, the motor should be able to brake the motion. This is not possible with the choking circuit of FIG. 5. Therefore the movements of the lift are in fact in this case controlled with the aid of the velocity measuring unit 24, in which as one member operates the velocity measurement amplifier 20, controlling the relay 17, which indirectly controls the motor and brake. Starting of the lift for fine adjustment is similarly accomplished as in case 1, that is, relay 14 releases and relay 12 attracts its armature (Upward direction). Now, however, the motor stirs slightly owing to the change of load even though the control voltage Uv is zero. The velocity of the lift cage begins to accelerate slowly; at the beginning the control voltage Uϕ also increases as long as Uv has a value lower than that implied by formula (3). When the velocity has increased so far that the value of Uv consistent with formula (3) is surpassed, Uϕ begins to change towards zero, whereby the thyristors of the choking elemet 22 cease to conduct and the motor torque is approximately zero. As the velocity continues to increase, and the lift cage has not yet reached the tolerance range, the velocity measurement amplifier 20 operates so that its output voltage becomes positive and, with the aid of transistor TR1, causes relay 17 to attract its armature. The point of operation is determined in accordance with formula (4) as follows:

$$U_v = \frac{R3}{R7} \cdot U \tag{4}$$

The value of voltage Uv, and of the equivalent velocity, is settable by means of the adjustable resistor 7. As the relay 17 attracts its armature, relay 14 also attracts its own, whereby the lift cage stops as in case 1. When the value of Uv consistent with formula (4) is so dimensioned that the equivalent velocity of the lift cage satisfies the condition of formula (2), the lift cage will move, after relay 17 has attracted its armature, at the most the distance 2Δs. Since the lift cage did not enter the tolerance range before relay 17 was energized, the lift cage will not have passed beyond the tolerance range when it has come to a standstill. If the lift cage reaches the tolerance range before relay 17 is energized, the velocity is lower than in formula (2) and the lift cage will stop when the logical signal from pick-up 11 changes to be "0", similarly as in case 1, and it will after coming to a standstill positively remain within the tolerance range. If the relay 17 is energized before the tolerance range, the lift cage will stop with the aid of the brake 3 and it may slide into, but not beyond, the tolerance range. If even after it has stopped the lift is not within the tolerance range after all, another run will automatically follow after a delay period tD. The delay tD is formed with the aid of the components D3, D4, R5 and C2 connected to the amplifier 20 and which maintain the output voltage of amplifier 20 at its positive value even though the voltage Uv has been reduced to zero as the lift cage came to a standstill. The delay tD is determined by the time constant R5C2, and this is selected long enough to ensure that the lift cage will positively stop. After passage of the time tD, another fine adjustment run takes place if the lift cage has failed to enter the tolerance range. Runs of this same kind are performed until the lift cage enters the tolerance range.

It is essential with regard to cases 1 and 2 that the velocity set with the aid of the adjustable resistor R6 is lower than the velocity set with the resistor R7, in order that the relay 17 might not unnecessarily stop the lift cage in a run consistent with case 1. The velocity set with resistor 7 should be lower than the velocity calculated by formula (2). This is not absolutely mandatory however, since if the lift cage is a run consistent with case 2, when the relay 17 attracts its armature, should during its stopping slip beyond the tolerance range, then the repeat fine adjustment run following after the time tD will be a situation consistent with case 1, and the lift cage will return into the tolerance range, because the direction of movement of the lift cage has changed equally as has the direction in which the load-induced torque acts.

It can further be shown that fine adjustment runs consistent with case 2 are exceedingly rare. This is due to the following circumstances. First, the area A-D-E-F in FIG. 4 is much smaller than area A-B-C-D; secondly, when the lift cage stops at a storey floor level from normal run, its accuracy of stopping is in the first place affected by the load in the lift cage. The error at stopping and the need for fine adjustment arise, logically, in accordance with the following table:

| Running direction | Load | Stopping point | Counter-torque in in fine adjustment |
|---|---|---|---|
| Up | Full cage | Below level | $MQ^1$ |
| Up | Empty cage | Above level | $MQ^1$ |
| Down | Empty cage | Above level | $MQ^1$ |
| Down | Full cage | Below level | $MQ^1$ |

and, thirdly, when the location of the lift cage changes as a result of loading or unloading, the lift cage tends, when it is being filled, to move down below the level and when it is being emptied, up above it, whereby with a high probability the counter-torque in fine adjustment will be positive.

From the above follows that fine adjustment running of the lift cage is accomplished in nearly every case with one single run. Those cases are rare in which more than one run is needed. This fact enables a simple control system like that desribed above to be used, in which only the traction torque of the drive motor is being controlled and in which those situations where braking is required have been simply managed with the aid of a velocity measuring unit and the mechanical brake of the lift.

It is obvious to a person skilled in the art that the invention is not merely confined to the example above described, and that different embodiments of the invention may vary within the scope of the claims following below.

I claim:

1. An improved method for exact alignment of an elevator car with the floor level of a building, said elevator being driven by an alternating current drive motor connected to a speed control, the current in one or several phases of the elevator drive motor being choked with a controllable choke element, wherein the improvement comprises the steps of: governing elevator car control by a control unit receiving elevator car true velocity from a feedback control loop imparting fine adjustment to the elevator car running at a slow speed, stopping at a selected floor level within a required tolerance range; operating speed control of the drive motor only in a range in which counter-torque of said motor is positive, and when motor counter-torque is negative, controlling the velocity of the elevator car with the aid of a velocity measuring unit acting upon an elevator car brake.

* * * * *